US009757845B2

(12) United States Patent
Nassab

(10) Patent No.: US 9,757,845 B2
(45) Date of Patent: Sep. 12, 2017

(54) DUAL-SETTING DIRECTIONAL TOOL

(71) Applicant: Paul Nassab, Parkville, MO (US)

(72) Inventor: Paul Nassab, Parkville, MO (US)

(73) Assignee: Spinal Simplicity, LLC, Overland Park, KS (US)

( * ) Notice: Subject to any disclaimer, the term of this patent is extended or adjusted under 35 U.S.C. 154(b) by 0 days.

(21) Appl. No.: 15/190,447

(22) Filed: Jun. 23, 2016

(65) Prior Publication Data

US 2016/0375564 A1 Dec. 29, 2016

Related U.S. Application Data

(60) Provisional application No. 62/185,988, filed on Jun. 29, 2015.

(51) Int. Cl.

| | |
|---|---|
| ***B25B 17/00*** | (2006.01) |
| ***B25B 13/48*** | (2006.01) |
| ***B25B 15/02*** | (2006.01) |
| *B25B 15/04* | (2006.01) |

(52) U.S. Cl.

CPC ..... *B25B 13/48* (2013.01); *B25B 15/02* (2013.01); *B25B 17/00* (2013.01); *B25B 13/481* (2013.01); *B25B 15/04* (2013.01)

(58) Field of Classification Search

CPC ... B25B 23/0035; B25B 13/467; B25B 15/04; B25B 17/00; B25B 13/481; B25B 17/02; B25B 21/002

USPC .. 81/57.3, 57.31, 57.32, 57.33, 57.34, 57.35

See application file for complete search history.

(56) References Cited

U.S. PATENT DOCUMENTS

| | | | | | |
|---|---|---|---|---|---|
| 2,721,591 | A | * | 10/1955 | Criswell | B25B 15/00 475/270 |
| 3,315,545 | A | * | 4/1967 | Schnoebelen | B25B 15/00 475/270 |
| 3,324,747 | A | * | 6/1967 | Able | B25B 21/002 81/57 |
| 4,535,653 | A | * | 8/1985 | Coburn | B25B 17/02 192/3.52 |
| 4,627,310 | A | * | 12/1986 | Coburn | B25B 17/02 192/3.52 |
| 4,846,027 | A | * | 7/1989 | Lu | B25B 17/00 81/57.3 |
| 5,406,866 | A | * | 4/1995 | Badiali | B25B 15/02 81/57.3 |

(Continued)

*Primary Examiner* — Larry E Waggle, Jr.
*Assistant Examiner* — Danny Hong
(74) *Attorney, Agent, or Firm* — Locke Lord LLP; Scott D. Wofsy; Arpita G. Buesing

(57) ABSTRACT

A dual-setting rotating system selectively provides unidirectional rotation to a drive shaft. Along with the drive shaft, the system includes a primary ratchet gear fixedly disposed on the drive shaft and configured to motivate the drive shaft in principal rotation. A secondary ratchet gear is coaxial with the primary ratchet gear and rotatably attached about at least a portion of the drive shaft. A pinion gear is axially-aligned with the drive shaft and operably engaged with the secondary ratchet gear and a shaft gear to motivate the drive shaft during retrograde rotation. The shaft gear is rigidly attached to and coaxial with the drive shaft. A clutch plate spans the primary and secondary ratchet gear while a main body encloses at least a portion of the clutch plate.

18 Claims, 7 Drawing Sheets

(56) References Cited

U.S. PATENT DOCUMENTS

| | | | | |
|---|---|---|---|---|
| 5,947,212 | A * | 9/1999 | Huang | B25B 15/02 173/216 |
| 6,035,746 | A * | 3/2000 | Lin | B25B 13/467 81/57.14 |
| 6,401,572 | B1 * | 6/2002 | Provost | B25B 17/02 81/57.14 |
| 8,122,788 | B2 * | 2/2012 | Gauthier | B25B 15/04 81/57.31 |
| 8,443,699 | B2 * | 5/2013 | Ha | B25B 13/463 81/475 |

* cited by examiner

Fig. 7
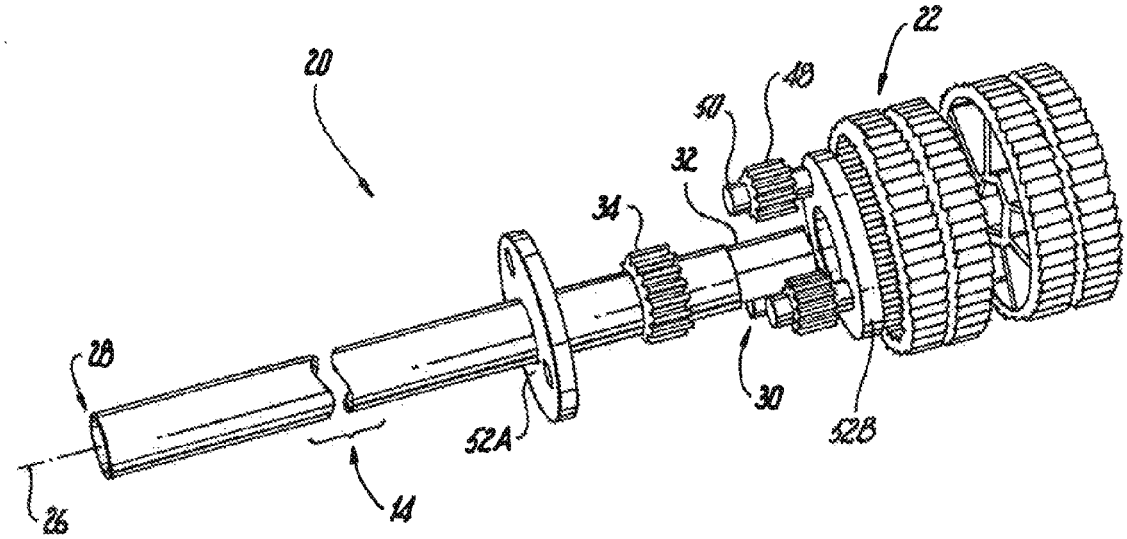
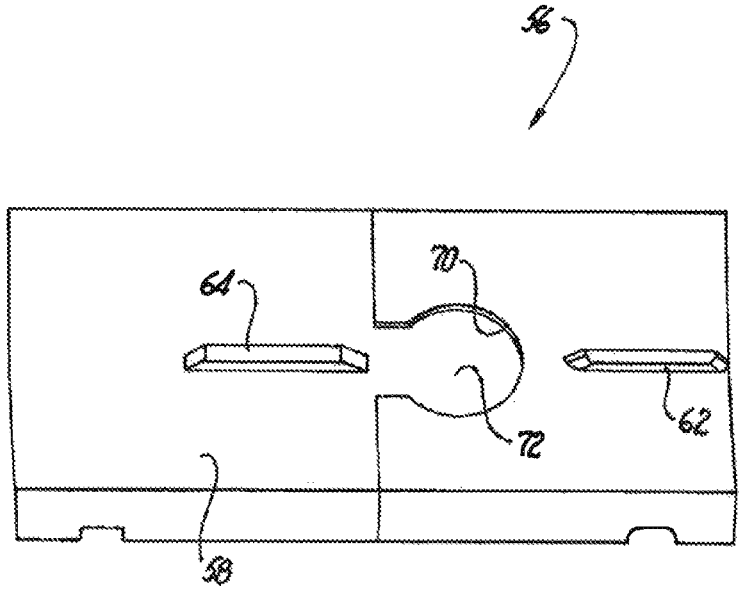
Fig. 8A

DUAL-SETTING DIRECTIONAL TOOL

CROSS-REFERENCE TO RELATED APPLICATIONS

This application claims the benefit of priority of U.S. Provisional Patent Application No. 62/185,988, filed Jun. 29, 2015, the disclosure of which is herein incorporated by reference in its entirety.

BACKGROUND OF THE INVENTION

1. Field of the Invention

The present invention relates generally to rotating tool systems, and more particularly, to rotating tool systems that are capable of transforming sequential rotational inputs from any of multiple orientations into rotational outputs having a single orientation.

2. Description of Related Art

Typical existing rotating tool systems suffer from a number of problems. First of all, many systems are only capable in transferring energy from one rotational input. This is seen in common wrenches or ratchets, which are only capable of turning a workpiece during a direct rotational input stroke. The return stroke, wherein the tool is turned in a direction opposite (i.e., retrograde) to the desired workpiece rotation, provides no rotational force. As a result, significant energy is lost, and half of the user's motion is wasted.

Although some existing tool systems are capable of providing unidirectional rotational movement during both the direct and return stroke, they also require an additional stabilizing force or input. The gearing systems of such tools are relatively inefficient and must be radially supported or held in place to turn a workpiece. This is especially problematic when a user attempts to rotate the tool in direction opposite of the workpiece. If such the tools are not supported or held in place, the workpiece will often be rotated in the wrong direction. However, forcing a user to support the tool while it turns greatly limits single-hand operation. If the user is unable to use two hands, existing systems are often no better than completely fixed tools. Oftentimes, this makes preexisting systems virtually unusable in delicate or single-hand uses. What is needed, then, is a unidirectional tool system having dual rotational inputs, which may be easily operated with one hand.

SUMMARY OF THE INVENTION

Aspects of the present invention provide a dual-setting rotating system having a drive shaft and a coaxial shaft gear rigidly attached thereto. A primary ratchet gear is fixedly disposed on the drive shaft and is configured to motivate the drive shaft in principal rotation. A secondary ratchet gear is rotatably disposed on the drive shaft and coaxial to the primary ratchet gear. A pinion gear is axially aligned with the drive shaft and configured to operably engage the shaft gear and secondary ratchet gear as it motivates the drive shaft in a direction opposite a retrograde rotation. A clutch plate spans the primary ratchet gear along with the secondary ratchet gear. Moreover, the clutch plate is configured to selectively engage the primary ratchet gear in principal rotation and the secondary ratchet gear in retrograde rotation. A main body encloses a least a portion of the clutch plate and directs it along a longitudinal axis.

In one aspect of the invention, the clutch plate has a face with a primary latch and a radially-independent parallel secondary latch. The primary latch is configured to selectively engage a primary ratchet gear in principal rotation and deflect away from the primary ratchet gear during retrograde rotation. The secondary latch is configured to selectively engage the secondary ratchet gear in retrograde rotation and deflect away from the secondary ratchet gear during principal rotation.

In another aspect of the invention, a dual-setting rotating tool is provided which includes a main body. The main body defines a central passage while a drive shaft extends through the central passage from a proximal tool end to a distal transmission end. A ratcheting assembly is further provided and includes a primary ratchet gear fixedly attached to the drive shaft, a coaxial secondary ratchet gear rotatably attached to the drive shaft, and a clutch plate, which has an inner face configured to operably engage the ratchet gears. The primary and secondary ratchet gears both have a discrete outer gear profiles. The secondary ratchet gear also has a discrete inner gear profile. A shaft gear is coaxially fixed to the drive shaft, and a pinion gear is positioned between the secondary ratchet gear and the drive shaft. The pinion gear is configured to operably engage the shaft gear and the inner gear profile of the secondary ratchet gear and also provide a second rotational force to the drive shaft in retrograde rotation.

In another aspect of the invention, a dual-setting rotating tool is provided which includes a main body. The main body defines a central passage and a longitudinal channel, while a drive shaft extends through the central passage from a proximal tool end to a distal transmission end. A ratcheting assembly is further provided at the distal transmission end of the drive shaft and includes a primary ratchet gear, a coaxial secondary ratchet, and a clutch plate. The primary ratchet gear is fixedly attached to the drive shaft and is configured to provide a first rotational force during principal rotation. The secondary ratchet gear is rotatably attached about the drive shaft. The ratchet gears both have a discrete outer gear profiles. The secondary ratchet gear also has a discrete inner gear profile. The clutch plate has an inner face and an outer face. The inner face has a primary latch configured to operably engage the primary ratchet gear, and a parallel secondary latch configured to operably engage the secondary ratchet gear.

A shaft gear is coaxially fixed to the drive shaft, and a plurality of pinion gears are positioned between the secondary ratchet gear and the drive shaft. The pinion gears are configured to operably engage the shaft gear and the inner gear profile of the secondary ratchet gear. Furthermore, the pinion gears are configured to provide a second rotational force to the drive shaft during retrograde rotation. A cap has a wall that defines a groove and covers at least a portion of the ratcheting assembly. A guide tab of the clutch plate extends radially outward from the outer face and through the main body channel into the cap groove. The guide tab thereby allows longitudinal movement of the clutch plate relative to the main body.

These and other features of the subject invention and the manner in which it is manufactured and employed will become more readily apparent to those having ordinary skill in the art from the following enabling description of the preferred embodiments of the subject invention taken in conjunction with the several drawings described below.

BRIEF DESCRIPTION OF THE DRAWINGS

So that those skilled in the art to which the subject invention appertains will readily understand how to make, use and assembly the portable gas cylinder of the subject invention without undue experimentation, preferred embodiments thereof will be described in detail herein below with reference to certain figures, wherein:

FIG. 7 is a partially exploded front perspective view of a drive shaft, pinion gears, and ratchet gears;

FIG. 8A is a perspective view of a clutch plate inner face;

DETAILED DESCRIPTION OF THE INVENTION

Figure 1:
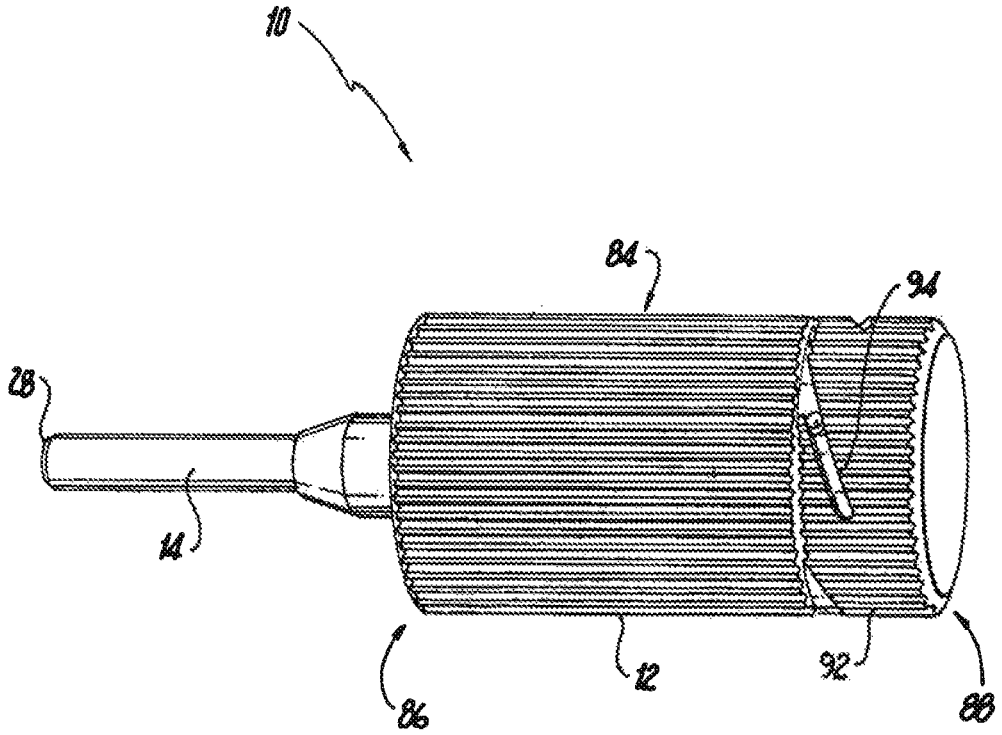
FIG. 1 a perspective view of one embodiment of one dual-setting rotating tool.

Reference will now be made in detail to optional embodiments of the invention, examples of which are illustrated in accompanying drawings. Whenever possible, the same reference numbers are used in the drawing and in the description referring to the same or like parts.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims. The terms "Axial" and "axially" refer to directions which are parallel to a set axis. The terms "Radial" and "radially" refer to directions perpendicular to a set point or axis.

As described herein, an upright position is considered to be the position of apparatus components while in proper operation or in a natural resting position as described herein. Vertical, horizontal, above, below, side, top, bottom and other orientation terms are described with respect to this upright position during operation unless otherwise specified. "Clockwise" and "counterclockwise" are described in relation to the rotational direction or force that would be provided to a separate body at the proximal or front end of the invention. The term "when" is used to specify orientation for relative positions of components, not as a temporal limitation of the claims or apparatus described and claimed herein unless otherwise specified. The terms "above," "below," "over," and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

Figure 2:
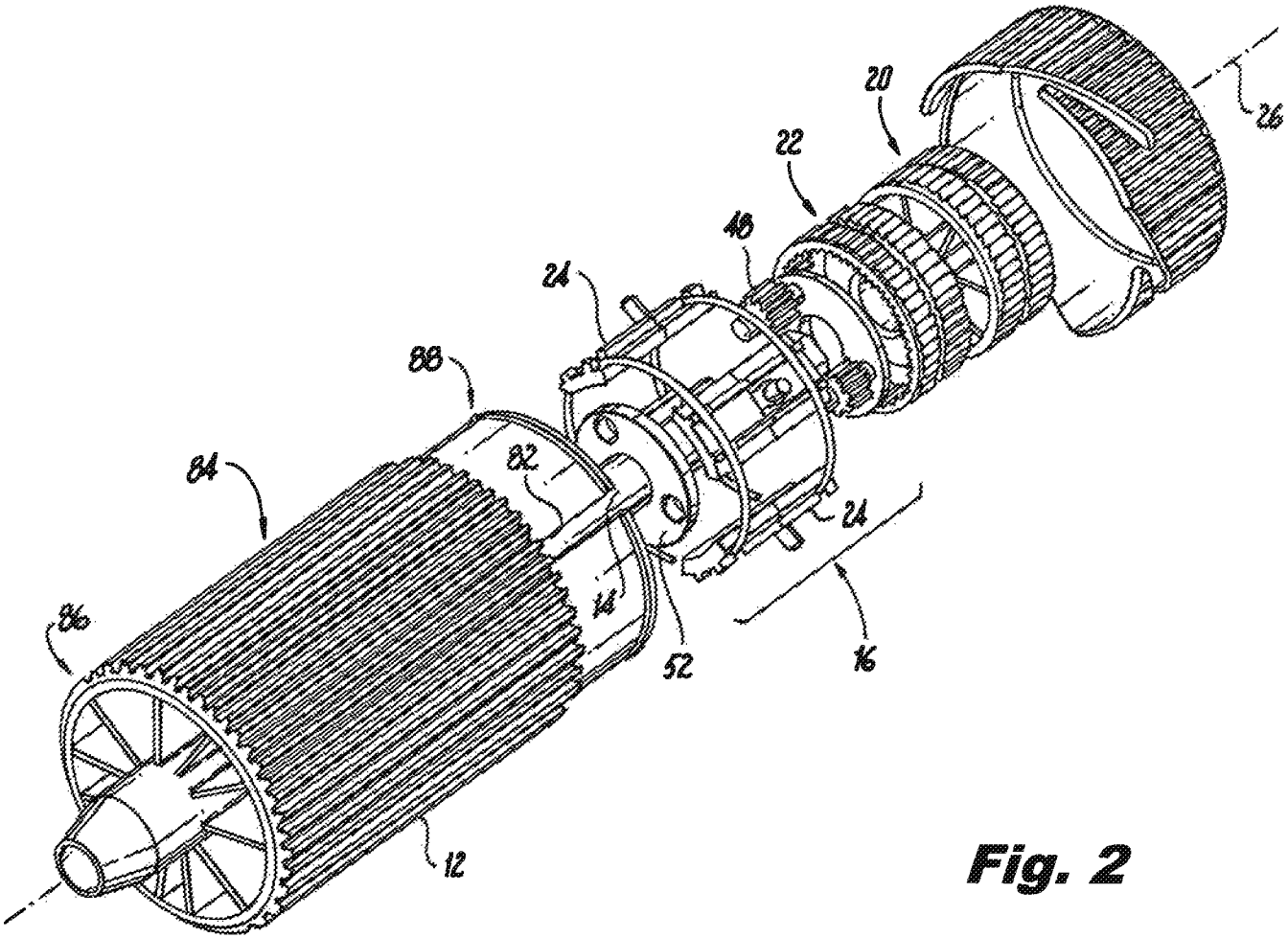
FIG. 2 is a partially exploded side view of an embodiment of a dual-setting rotating tool.

Referring generally now to FIGS. 1-10, an exemplary dual-setting rotating tool 10 according to the present disclosure includes a main body 12, along with a drive shaft 14 attached thereto. As shown in FIG. 2, various embodiments include a ratcheting assembly 16 positioned at least partially within the main body 12 and the cap 18. The ratcheting assembly of such embodiments includes coaxial ratchet gears 20, 22 and a clutch plate 24. As will be described below, the tool 10 is configured to have at least a first and a second operational mode. The first operational mode provides unidirectional drive shaft rotation in a clockwise direction relative to one orientation of the tool; the second operational mode provides unidirectional drive shaft rotation in a counterclockwise direction relative to the same orientation of the tool. As a result, the tool 10 is capable of turning the drive shaft 14 in a preselected direction in accordance with both principal and retrograde rotations.

As shown in FIG. 7, the drive shaft 14 of some embodiments extends along a longitudinal axis 26 from a proximal tool end 28 to a distal transmission end 30. The proximal tool end 28 of certain embodiments is configured to engage a workpiece or discrete tool element. Optional embodiments of the proximal tool end define a polygonal cavity that selectively receives discrete tool elements, including replaceable tool bits, such as a screwdriver head or socket. Alternative embodiments of the proximal tool end include an integrally-formed tool head that can directly engage a workpiece.

The distal transmission end 30 of some embodiments selectively receives the ratcheting assembly 16. A notch or polygonal head 32 is formed along the longitudinal length of certain drive shaft 14 embodiments. When the ratcheting assembly 16 is placed on the distal transmission end 30, the notch or polygonal head 32 engages the primary ratchet gear 20 and ensures the primary ratchet gear 20 remains angularly fixed relative to the drive shaft 14.

The embodiment of FIG. 7 shows shaft gear 34 joined to the drive shaft 14. The shaft gear 34 is coaxial with the drive shaft 14 along the longitudinal axis 26. During operation, rotation of the drive shaft 14 necessarily rotates the shaft gear 34, thereby maintaining the shaft gear 34 in a rigid position relative to the drive shaft 14. Certain embodiments of the shaft gear 34 include a discrete ring gear that is selectively removable from the drive shaft 14. In other embodiments, the shaft gear 34 is permanently disposed onto the drive shaft 14. Optionally, the shaft gear 34 may be integrally formed along the longitudinal length of the drive shaft 14.

Some embodiments of the shaft gear 34 include a gear tooth profile that extends radially from the longitudinal axis 26. Optionally, the gear tooth profile may be formed as a spur or helical gear. Turning to FIGS. 2-5, the ratcheting assembly 16 of some embodiments is selectively positioned at the distal transmission end 30, as shown. In such embodiments, the primary ratchet gear 20 and the secondary ratchet gear 22 attach to the drive shaft 14 along the longitudinal axis 26. Moreover, when attached, the primary ratchet gear 20 will be maintained at an angularly fixed position relative to drive shaft 14. Optionally, an axial fastener may hold the ratchet gears 20, 22 in a fixed longitudinal position. In some embodiments, the axial fastener is a screw, bolt, pin, or washer. During operation, both ratcheting gears 20, 22 are coaxial with the drive shaft 14.

Furthermore, during operation, the secondary ratchet gear 22 is rotatably attached about the drive shaft 14. While the primary ratchet gear 20 motivates the drive shaft 14 during principal rotation (i.e., rotation coincident with the selected direction of rotation for the drive shaft) with a first rotational force, the secondary ratchet gear 22 provides a motive force during retrograde rotation (i.e., rotation opposite the selected direction of rotation for the drive shaft).

Figure 3:
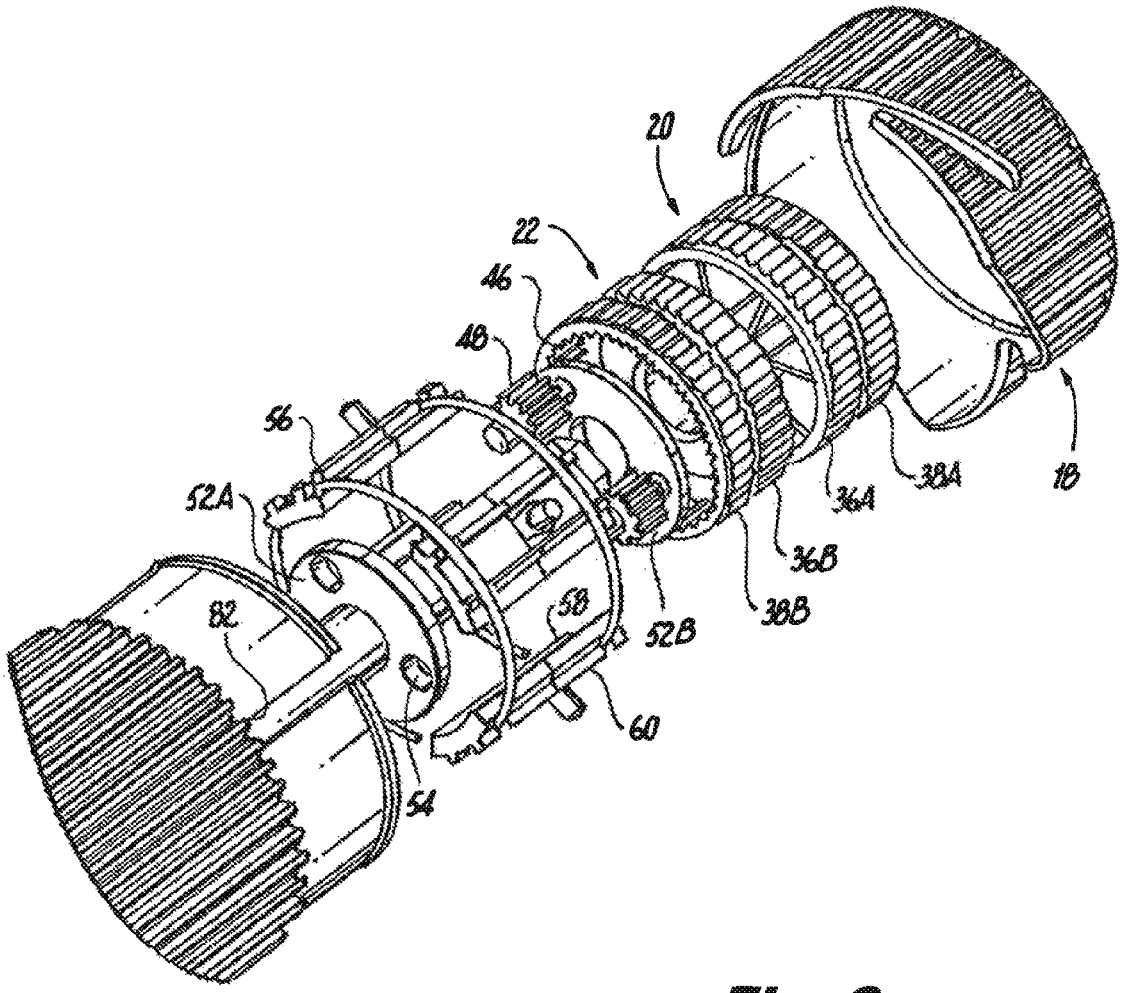
FIG. 3 is a partially exploded rear perspective view of the embodiment of FIG. 2.
Figure 9:
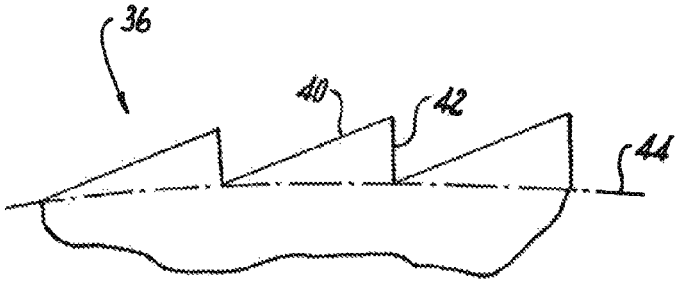
FIG. 9 is a rear plan view of a clockwise ratchet gear tooth profile.

As seen in FIG. 3, both ratchet gears 20, 22 have discrete outer gear profiles. In some embodiments, this includes at least two sets of teeth (i.e., tooth sets) 36, 38. In certain embodiments, both sets of teeth 36, 38 are concentric to each other and have asymmetrical outer gear profiles shaped in opposite directions. The clockwise tooth set 36 has a gear profile that directs each tooth in a clockwise direction, as illustrated in FIG. 9. The coast face 40 of each tooth generally extends towards the clockwise direction and has an overall angle relative to the root plane 44 that is less than that of the drive face 42. As a result, a latch 62, 64 may engage the clockwise tooth set 36 as the respective ratchet gear rotates in a clockwise direction. When the ratchet gear rotates in a counterclockwise direction, the latch 62, 64 may deflect to allow relative rotation of the tooth set 36.

Figure 10:
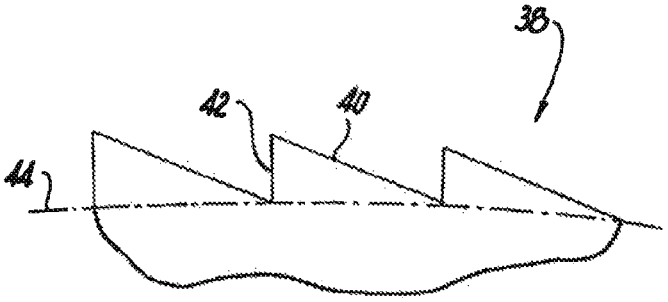
FIG. 10 is a rear plan view of a counterclockwise ratchet gear tooth profile.

Similarly, the counterclockwise tooth set 38, illustrated in FIG. 10, has a gear profile that directs each tooth in a counterclockwise direction. The coast face 40 of each tooth generally extends towards the counterclockwise direction and maintains an overall angle relative to the root plane 44 that is less than that of the drive face 42. As a result, a latch may engage the counterclockwise tooth set 38 as the respective ratchet gear rotates in a counterclockwise direction. When the ratchet gear rotates in a counterclockwise direction, the latch 62, 64 may deflect to allow relative rotation of the tooth set 38.

The tooth sets 36, 38 of certain embodiments are formed on an outer surface of the ratchet gears 20, 22 in a reflected order. In the embodiment of FIG. 3, the clockwise tooth set 36A of the primary ratchet gear 20 is disposed in a proximal position while the counterclockwise tooth set 38A is disposed in a distal position. In contrast, the clockwise tooth set 36B of the secondary ratchet gear 22 is disposed in a distal position while the counterclockwise tooth set 38B is disposed in a proximal position.

The secondary ratchet gear 22 of some embodiments also includes a third, or retrograde, tooth set 46 formed on an inner surface of the secondary ratchet gear. The retrograde tooth set 46 has a gear profile that extends radially inward and operably engages one or more pinion gears 48. The pinion gear 48 is disposed between the retrograde tooth set 46 and drive shaft 14. Moreover, the pinion gear 48 includes a rotation pin 50 that extends longitudinally to define the pinion gear's axis of rotation. One or more retention plates 52 may attach to or receive the rotation pin 50 and maintain the axial or longitudinal position of the pinion gear 48 relative to the drive shaft 14. The retention plate 52 of certain embodiments includes a disk defining one or more pin openings 54. The retention plate 52 of such embodiments may be coaxially attached to the drive shaft 14 and thereby permit angular movement of the pinion gear 48 with respect to the drive shaft 14.

As shown in FIGS. 3 and 7, some embodiments include at least two retention plates 52A, 52B. A first retention plate 52A is positioned at a proximal end of the rotation pin 50. The second retention plate 52B is positioned at the rotation pin's distal end. Optionally, the outer radius of the proximal retention plate 52A is greater than the outer radius of the distal retention plate 52B. In such embodiments, the distal retention plate 52B may be positioned within the secondary ratchet gear 22.

Figure 5:
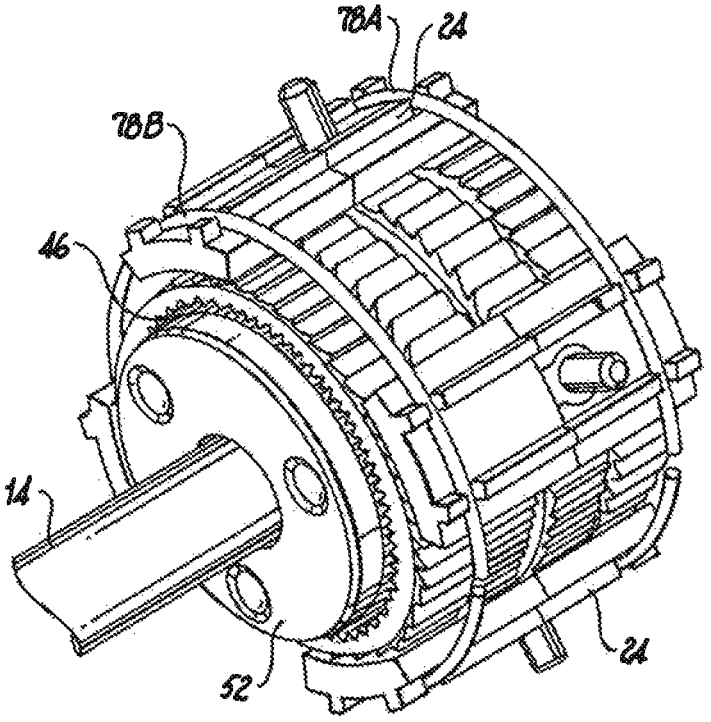
FIG. 5 is a front perspective view of a ratcheting assembly and drive shaft.
Figure 6:
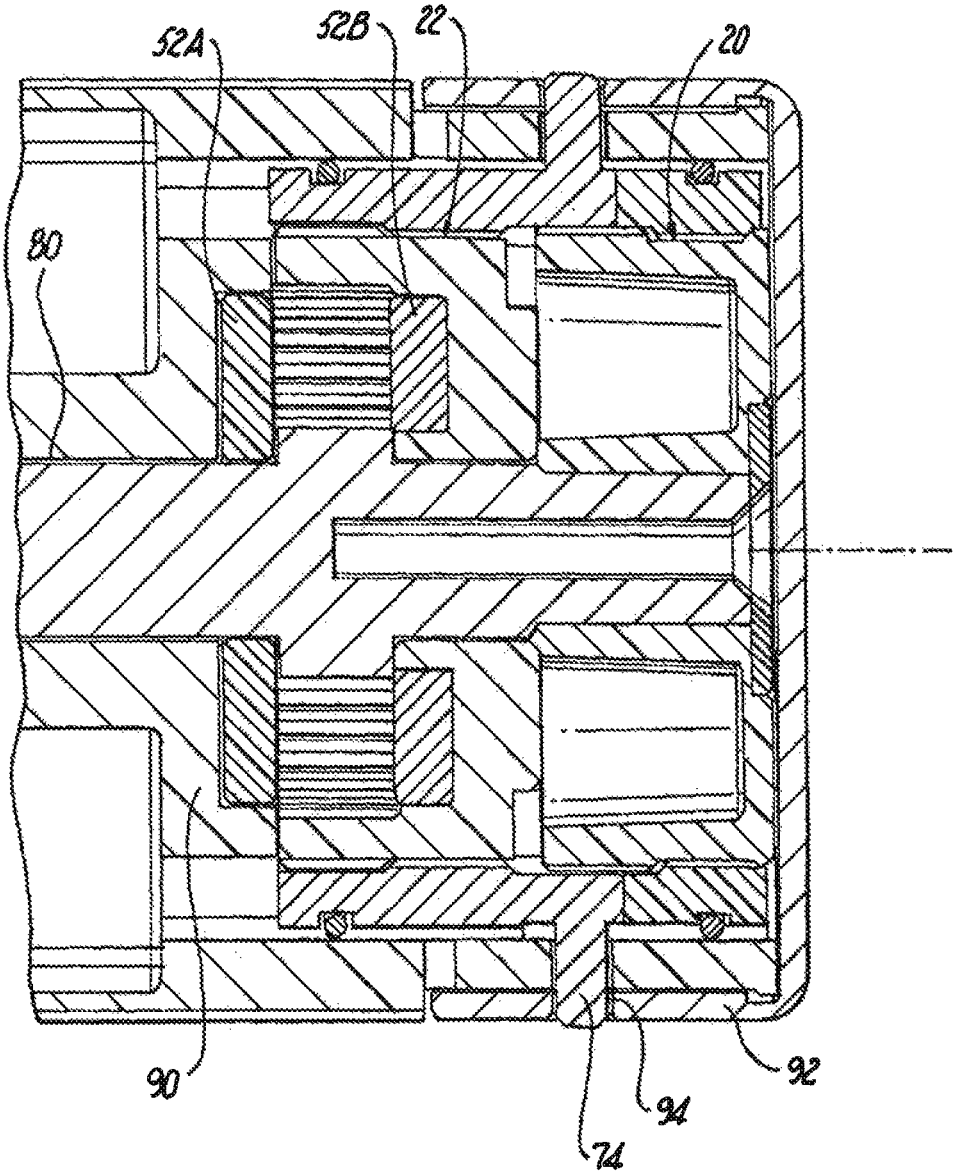
FIG. 6 is a cut-away side view of a dual-setting rotating tool embodiment.

During operation of certain embodiments, the pinion gear 48 is operably meshed between the secondary ratchet gear 22 and the drive shaft 14, as shown in FIGS. 5-6. At this position, the rotation pin 50 is axially aligned to be parallel with the drive shaft 14. The pinion gear 48 meshes with the retrograde tooth set 46 and the shaft gear 34 to thereby rotate the drive shaft 14 in a direction opposite the secondary ratchet gear 22 through a second rotational force. This second rotational force ensures unidirectional movement of the drive shaft 14 during retrograde rotation of the secondary ratchet gear 22.

Turning to FIGS. 3-6 and 8A-8B, some embodiments of the ratcheting assembly 16 include one or more clutch plates 24 having an inner face 58 and an outer face 60. The inner face 58 is directed toward the ratchet gears 20, 22 during operation and includes two parallel latches 62, 64 extending radially inward along a longitudinal length. In some embodiments, the longitudinal length of the latches 62, 64 generally corresponds to the longitudinal length of one of the ratchet gear tooth sets 36, 38. In such embodiments, the latches 62 may be selectively moved along the longitudinal axis 26 to be alternately engaged or disengaged from an individual tooth set. During operation, the inner face 58 spans across (i.e., extends over at least a portion of) the primary ratchet gear 20 and secondary ratchet gear 22. The primary latch 62 may selectively engages the primary ratchet gear 20 while the secondary latch 64 selectively and individually engages the secondary ratchet gear 22. More specifically, depending on the operational mode, the primary latch 62 individually engages either the primary ratchet gear's clockwise tooth set 36A or counterclockwise tooth set 38A; the secondary latch 64, by contrast, individually engages either the secondary ratchet gear's clockwise tooth set 36B or counterclockwise tooth set 38B.

Optional embodiments of the clutch plate 24 include a radially-independent distal body 66 and proximal body 68. In such embodiments, a recess 70 defined by the distal body 66 receives a key 72 which is laterally fixed to the proximal body 68. The recess 70 extends uniformly from the inner face 58 to the outer face 60 to maintain consistent profile. The key 72 is formed to substantially complement the profile of the recess 70. As a result, the distal body 66 and proximal body 68 may move independently in a radial direction, but still remain while remaining longitudinally and angularly fixed with respect to one another.

In alternative embodiments, the clutch plate 24 is integrally formed from one or more resilient materials. In primary rotation of such embodiments, a first half of the clutch plate 24 is operably engages one ratchet gear 20, 22 while a second half of the clutch plate 24 is resiliently deflected away from the other ratchet gear 22, 20. In retrograde rotation of such embodiments, the first half of the clutch plate 24 resiliently deflects away from one ratchet gear 20, 22 while the second half of the clutch plate 24 operably engages the other ratchet gear 22, 20.

In some embodiments, the clutch plate 24 includes a guide tab 74 extending radially to control longitudinal movement of the clutch plate 24. In optional embodiments, the guide tab 74 extends in a radial direction opposite the latches 62, 64. In other optional embodiments, the clutch plate 24 further includes a spring channel 76. The spring channel 76 receives a spring 78 that biases the clutch plate in a radial direction. During operation, this direction of bias is towards the ratchet gears 20, 22. In optional embodiments, the spring 78 includes a resilient ring spring comprised of a suitably flexible material to return to a predetermined shape and position after being deformed or deflected. In other embodiments, the spring 78 includes a compression, plate, or torsion spring comprised of a suitably flexible material to return to a predetermined shape and position after being deformed or deflected.

Figure 4:
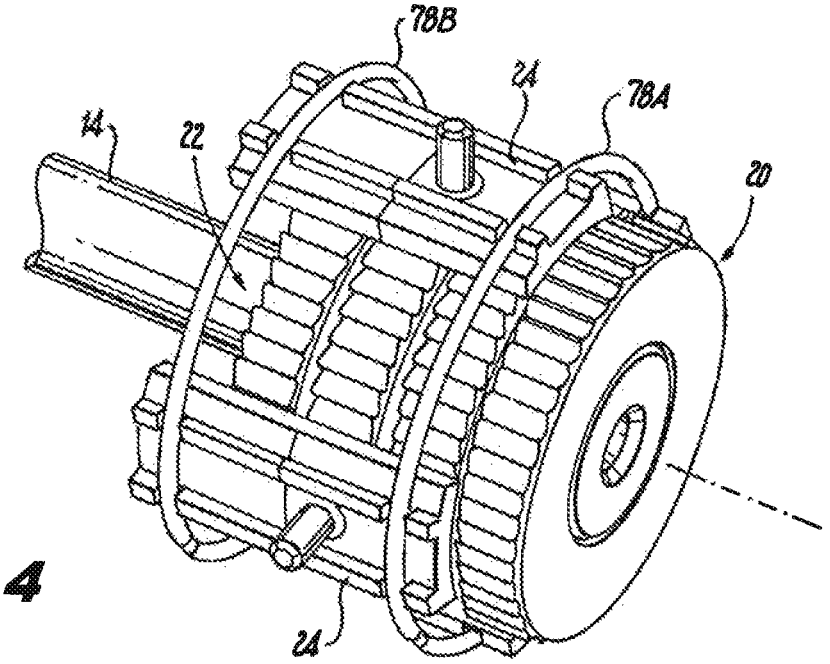
FIG. 4 is a rear perspective view of a ratcheting assembly and drive shaft.
Figure 8B:
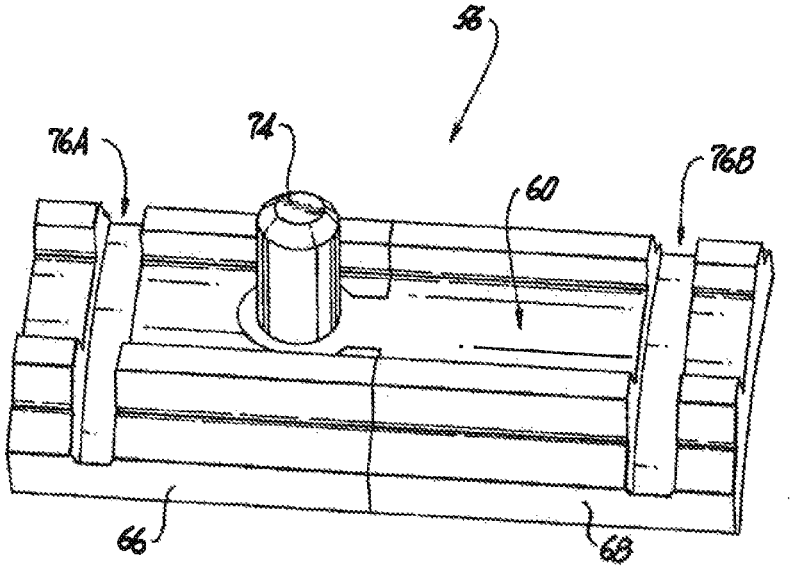
FIG. 8B is a perspective view of a clutch plate outer face.

As seen in FIG. 8B, the guide tab 74 and spring channel 76 of certain embodiments are disposed on the outer face 60. In such embodiments, the guide tab may extend radially outward from the outer face 60. In contrast, the spring channel 76 may be defined by a void extending across the clutch plate 24. During operation, the spring channel of such embodiments extends orthogonal to the longitudinal axis 26. In embodiments including a distal body 66 and proximal body 68, each body includes a discrete spring channel 76A and 76B, respectively. Each discrete spring channel 76A and 76B receives a different respective spring 78A and 78B, as shown in FIG. 4. During operation of some embodiments, clutch plate 24 may be positioned in a first and a second operational mode. The unidirectional rotational direction of the drive shaft 14 will be determined by the operational mode and largely controlled by the longitudinal position of the clutch plate 24.

In the first operational mode, the selected unidirectional rotation direction is clockwise. In the operational mode of some embodiments, the clutch plate 24 is positioned so that the primary latch 62 is engaged with the counterclockwise tooth set 38A and the secondary latch 64 is likewise engaged with the clockwise tooth set 36A. Rotation of the clutch plate 24 in a clockwise direction will motivate the primary ratchet gear 20, and thereby the drive shaft 14, in that same direction. The primary latch 62 is actuated against the driving face 42 of the counterclockwise tooth set 38A to provide a first rotational force. Simultaneously, the secondary latch 64 passes over the coast face 40 of the secondary ratchet gear 22. The proximal body 68 deflects radially outward with the increasing coast face radial height; the spring forces the proximal body 68 radially inward when the proximal body 68 reaches a new tooth.

Reversing rotation of the clutch plate 24 brings the secondary latch 64 into engagement with the driving face 42 of the clockwise tooth set 36B. As a result, the secondary latch 64 motivates the secondary ratchet gear 22 in a counterclockwise direction. Simultaneous to the secondary ratchet gear rotation, the retrograde tooth set 46 motivates the pinion gear 48 in counterclockwise rotation about the rotation pin 50. The pinion gear 48 provides a second rotational force from the movement of the secondary ratchet gear 22 to, again, rotate the drive shaft 14 in the clockwise direction.

The second operational mode directs the drive shaft 14 in the counterclockwise direction. During use, the second operational mode functions largely the same as the first operational mode. The clutch plate 24 is positioned so that the primary latch 62 is engaged with the clockwise tooth set 36A and the secondary latch 64 is engaged with the counterclockwise tooth set 38A. This positioning effectively reverses the above-described first operational mode movement and forces the drive shaft 14 to rotate in the counterclockwise direction.

Returning to FIGS. 1-3 and 6, some embodiments further include a main body 12 that defines both a central passage 80 and a longitudinal channel 82. A handle grip 84 faces radially outward from the central passage 80 and extends longitudinally from a proximal handle end 86 to a distal handle end 88. In certain embodiments, the longitudinal channel 82 is defined within the handle grip 84 at the distal handle end 88. Optional embodiments of main body 12 also include a crown 90 that extends radially outward from the central passage 80, but within the handle grip 84. The crown 90 may optionally receive a retention plate 52 and maintain the pinion gears 48 at a predetermined position relative to the shaft gear 34.

As shown in FIG. 6, the central passage 80 is sized to receive the drive shaft 14, which may be rotatably positioned therein. During principal rotation of the main body 12, the drive shaft 14 maintains a predetermined angular position relative to the main body 12. However, during retrograde rotation, the drive shaft 14 is angularly displaced in a direction opposite the rotation of the main body 12.

Some embodiments include a cap 18 that is rotatably positioned over a portion of the distal handle end 88. The cap 18 of certain embodiments includes a wall 92 that defines one or more grooves 94. The groove 94 is sized so that its width generally corresponds in size to the thickness of the guide tab 74. As a result, when the cap 18 is placed over the main body 12, the guide tab 74 of the clutch plate will extend through the main body longitudinal channel 82 and into the groove 94. In optional embodiments, the groove 94 is helically shaped, as seen in FIG. 1. Rotating the cap 18 relative to the main body 12 forces the guide tab 74 (and therefore the clutch plate 24) back and forth along the longitudinal axis 26. Rotating the cap 18 in one direction will force the clutch plate 24 rearward (i.e., away from the drive shaft proximal end) relative to the ratchet gears 20, 22, while rotating the cap 18 in the opposite direction will force the clutch plate 24 forward (i.e., towards the drive shaft proximal end). In this way, a user may selectively position the clutch plate 24, and thereby select the operational mode of the system.

Optional embodiments of the cap 18 include markings along the groove 94 denoting which operational mode system will be in if the clutch plate 24 is placed at certain locations along the groove 94. In other embodiments, the groove 94 has a first and a second end, which, respectively, define the first and the second operational mode placements of the clutch plate 24.

This written description uses examples to disclose the invention and to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful Dual-Setting Directional Tool, it is not intended that such references be construed as limitations upon the scope of this invention except as set forth in the following claims.

What is claimed is:

1. A dual-setting rotating system comprising:

a drive shaft extending along a longitudinal axis;

a shaft gear rigidly attached and coaxial to the drive shaft;

a primary ratchet gear fixedly disposed on the drive shaft and configured to motivate the drive shaft during principal rotation;

a secondary ratchet gear coaxial with the primary ratchet gear and rotatably disposed on the drive shaft;

a pinion gear axially-aligned with the drive shaft and operably engaged with the shaft gear and the secondary ratchet gear, the pinion gear being configured to motivate the shaft gear during retrograde rotation;

a clutch plate spanning the primary ratchet gear and the secondary ratchet gear, the clutch plate being configured to selectively engage the primary ratchet gear in principal rotation and the secondary ratchet gear in retrograde rotation; and a main body enclosing at least a portion of the clutch plate and configured to direct the clutch plate in a longitudinal direction, wherein the clutch plate includes a first face having a primary latch and a radially-independent parallel secondary latch;

the primary latch is configured to selectively engage the primary ratchet gear in principal rotation and deflect away from the primary ratchet gear during retrograde rotation; and the secondary latch is configured to selectively engage the secondary ratchet gear in retrograde rotation and deflect away from the secondary ratchet gear during principal rotation.

2. The system of claim 1, wherein:

the main body defines a longitudinal channel configured to direct longitudinal movement of the clutch plate; and the clutch plate includes a guide tab extending radially through the longitudinal channel.

3. The system of claim 2, further including a cap disposed at least partially about the main body, the cap including a wall defining a groove configured to control longitudinal movement of the clutch plate;

wherein the guide tab extends at least partially into the groove.

4. The system of claim 1, further comprising a plurality of clutch plates positioned at least partially about the drive shaft.

5. The system of claim 4, further comprising a plurality of retainer springs biasing the plurality of clutch plates towards the primary ratchet gear and the secondary ratchet gear.

6. The system of claim 1, wherein the secondary ratchet gear includes a discrete inner tooth set coaxial to the drive shaft and operably meshed with the pinion gear.

7. The system of claim 6, wherein:

the pinion gear includes a proximal rotation pin end and a distal rotation pin end; and the system further comprises a proximal retention plate disposed on the proximal rotation pin end, and a distal retention plate disposed on the distal rotation pin end.

8. The system of claim 7, wherein each retention plate includes a disk disposed about the drive shaft and coaxial thereto.

9. The system of claim 7, further comprising a plurality of parallel pinion gears positioned between the proximal retention plate and the distal retention plate.

10. A dual-setting rotating tool comprising:

a drive shaft extending along a longitudinal axis from a proximal tool end to a distal transmission end;

a main body defining a central passage configured to support the drive shaft;

a ratcheting assembly including:

a primary ratchet gear fixedly attached to the drive shaft and configured to provide a first rotational force to the drive shaft during principal rotation, the primary ratchet gear including an outer gear profile, a secondary ratchet gear coaxial with the primary ratchet gear and rotatably attached about at least a portion of the drive shaft, the secondary ratchet gear including a discrete outer gear profile and a discrete inner gear profile, and a clutch plate having an inner face configured to operably engage the primary ratchet gear in primary rotation and operably engage the secondary ratchet gear in retrograde rotation;

a shaft gear coaxially fixed to the drive shaft along the longitudinal axis; and a pinion gear positioned between the secondary ratchet gear and the drive shaft, the pinion gear being configured to operably engage the shaft gear and the inner gear profile of the secondary ratchet gear, the pinion gear being further configured to provide a second rotational force to the drive shaft during retrograde rotation, wherein the clutch plate inner face includes a primary latch and a secondary latch parallel to the primary latch;

the primary latch is configured to selectively engage the primary ratchet gear in principal rotation and deflect radially outward from the primary ratchet gear during retrograde rotation; and the secondary latch is configured to selectively engage the secondary ratchet gear in retrograde rotation and deflect radially outward from the secondary ratchet gear during principal rotation.

11. The tool of claim 10, wherein:

the primary ratchet gear outer gear profile includes a discrete clockwise tooth set and a discrete counterclockwise tooth set;

the primary latch extends radially towards the primary ratchet gear; and the primary latch is configured to operably engage the clockwise tooth set in a first operational mode and operably engage the counterclockwise tooth set in a second operational mode.

12. The tool of claim 10, further comprising:

a plurality of clutch plates positioned at least partially about the primary ratchet gear and the secondary ratchet gear; and a retainer spring attached to the plurality of clutch plates and biasing each clutch plate radially inward towards the primary ratchet gear and secondary ratchet gear.

13. The tool of claim 10, further comprising a cap covering at least a portion of the ratcheting assembly, the cap including a wall defining at least one groove;

wherein the clutch plate includes a guide tab configured to control movement of the clutch plate relative to the primary ratchet gear and secondary ratchet gear, the guide tab extending radially outward into the groove.

14. The tool of claim 13, wherein:

the main body includes a handle grip spanning the ratcheting assembly and defining a longitudinal channel configured to direct longitudinal movement of the guide shaft; and the clutch plate guide tab extends through the longitudinal channel.

15. The tool of claim 10, further comprising a retention plate coaxially disposed on the drive shaft;

wherein the pinion gear includes a rotation pin attached to the retention plate and extending in a longitudinal direction.

16. The tool of claim 15, wherein:

the main body includes a crown extending radially about the longitudinal axis and configured to receive the drive shaft; and the retention plate is positioned at least partially within the crown.

17. The tool of claim 10, further comprising a plurality of pinion gears axially-positioned around the drive shaft.

18. A dual-setting rotating tool comprising:

a drive shaft extending along a longitudinal axis from a proximal tool end to a distal transmission end;

a main body defining a central passage configured to support the drive shaft;

a ratcheting assembly positioned at the drive shaft distal transmission end, the ratcheting assembly including:

a primary ratchet gear fixedly attached to the drive shaft and configured to provide a first rotational force to the drive shaft during principal rotation, the primary ratchet gear including an outer gear profile, a secondary ratchet gear coaxial with the primary ratchet gear and rotatably attached about at least a portion of the drive shaft, the secondary ratchet gear including a discrete outer gear profile and a discrete inner gear profile, and a clutch plate having an inner face and an outer face, the inner face including a primary latch configured to operably engage the primary ratchet gear in principal rotation and a parallel secondary latch configured to operably engage the secondary ratchet gear in retrograde rotation, the clutch plate further including a guide tab extending radially outward from the outer face;

a plurality of pinion gears positioned between the secondary ratchet gear and the drive shaft, the pinion gears being configured to operably engage the drive shaft and the inner gear profile of the secondary ratchet gear, the plurality of pinion gears being further configured to provide a second rotational force to the drive shaft during retrograde rotation; and a cap including a wall covering at least a portion of the ratchet assembly, the wall further defining a groove configured to control longitudinal positioning of the clutch plate relative to the main body;

wherein the clutch plate guide tab extends through the main body into the cap groove.

* * * * *